US007931055B2

(12) United States Patent
Reimler

(10) Patent No.: US 7,931,055 B2
(45) Date of Patent: Apr. 26, 2011

(54) LOG DEBARKING TOOL AND TOOL TIP

(76) Inventor: James L. Reimler, Charlotte, NC (US)

( * ) Notice: Subject to any disclaimer, the term of this patent is extended or adjusted under 35 U.S.C. 154(b) by 98 days.

(21) Appl. No.: 12/368,746

(22) Filed: Feb. 10, 2009

(65) Prior Publication Data

US 2010/0200116 A1 Aug. 12, 2010

(51) Int. Cl.
*B27L 1/08* (2006.01)

(52) U.S. Cl. ..... 144/208.1; 144/208.8; 144/241

(58) Field of Classification Search ..... 144/208.1, 144/208.4, 208.5, 208.7–208.9, 235, 241; 407/65

See application file for complete search history.

(56) References Cited

U.S. PATENT DOCUMENTS

| | | | | |
|---|---|---|---|---|
| 2,788,034 | A | 4/1957 | Brundell et al. | |
| 2,880,771 | A | 4/1959 | Annis, Jr. | |
| 3,190,327 | A | 6/1965 | Robbins | |
| 3,221,785 | A | 12/1965 | Valo | |
| 3,653,417 | A | 4/1972 | Cervenak | |
| 3,704,733 | A | 12/1972 | McColl | |
| 3,709,272 | A | 1/1973 | Bowers | |
| 3,718,167 | A | 2/1973 | Cervenak | |
| 3,973,607 | A | 8/1976 | Jonsson | |
| 3,991,800 | A | 11/1976 | Palmquist | |
| 4,280,541 | A | 7/1981 | Reimler et al. | |
| 4,425,951 | A * | 1/1984 | Pousette et al. | 144/208.8 |
| 4,566,371 | A | 1/1986 | Jorgensen et al. | |
| 4,653,559 | A | 3/1987 | Ackerman | |
| 4,657,056 | A | 4/1987 | Hutson | |
| 4,823,816 | A * | 4/1989 | Maruska | 460/53 |
| 4,844,201 | A | 7/1989 | Ackerman | |
| 4,865,095 | A | 9/1989 | Magnusson | |
| 5,201,353 | A | 4/1993 | Weill | |
| 5,460,212 | A | 10/1995 | Darden | |
| 5,472,027 | A | 12/1995 | Ackerman | |
| 5,915,888 | A * | 6/1999 | Minicozzi | 407/54 |
| 6,260,592 | B1 * | 7/2001 | Lindholm | 144/208.8 |
| 6,675,846 | B1 | 1/2004 | Hoffman | |
| 6,834,692 | B2 | 12/2004 | Lindsay et al. | |
| 7,350,548 | B1 | 4/2008 | Cholewczynski et al. | |
| 7,743,805 | B2 * | 6/2010 | Lefsrud | 144/208.8 |

* cited by examiner

*Primary Examiner* — Shelley Self
(74) *Attorney, Agent, or Firm* — Adams Law Group of Oliff & Berridge

(57) ABSTRACT

A tool for a ring-rotor log debarker, including an elongate, curved body for being attached by one end to a ring rotor of a log debarker. At least one attachment hole extends through the curved body of the tool on a free end opposite the one end attached to the ring rotor, and communicates with the first and second upstream and downstream oriented surfaces. A tip is placed onto the free end of the tool body, and includes an attachment hole sized and positioned for alignment with the at least one attachment hole in the tool body and for receiving a bolt through the aligned attachment holes for securing the tip to the tool body.

8 Claims, 6 Drawing Sheets

LOG DEBARKING TOOL AND TOOL TIP

TECHNICAL FIELD AND BACKGROUND OF THE INVENTION

This invention relates to debarking machines generally referred to as "mechanical ring" debarkers. Debarkers of this type have a ring rotor into and through which successive logs are fed to be engaged and stripped of bark. More particularly, the invention is concerned with an improved debarking blade for mechanical ring debarking machines wherein the tip of the blade is designed so that it can be quickly and easily removed from the blade and replaced In debarking machines of the ring rotor type, several debarking tools are circularly arranged around the central opening of the rotor and extend generally radially inwardly with their cutting edges positioned adjacent to the axis of the rotor. As they are rotated by the ring rotor, the blades follow the periphery of the logs while the cutting tips remove the bark. When the rotor is rotated and a log is being fed into the rotor inlet, the leading butt end of the log engages the debarking tools and causes them to move outwardly as they rotate so that the opening edges of the tools climb upwardly onto the peripheral surfaces of the log, progressively peeling the bark from the log as it moves past the rotating tools. Conventional debarking machines have tools with a climbing blade and a removable and replaceable blade tip. The blade tip is positioned in such a way that it is difficult to remove and replace, because the attachment bolts are positioned on the side of the blade perpendicular to the longitudinal axis of movement of the log through the rotating tools. For this reason, the tools adjacent to the tool whose tip is being removed and replaced interfere with proper access to the bolts for removal and replacement. Typically, therefore, hand-operated tools are used, or the tension on the tools is released in order to move adjacent tools out of the way. The weight of a single blade is typically between 15 and 125 pounds. The process of removing and replacing the tool tips as described above becomes progressively more difficult as the weight of the tools increases.

Blade tips should be tightened to a specified torque to prevent damage to the tip and tool, and to prevent the tip from becoming loose during use. Conventional blade tip location makes placing proper torque on the blade tip difficult by preventing or impeding use of an impact wrench with torque settings.

SUMMARY OF THE INVENTION

Therefore, it is an object of the invention to provide a debarking tool for a ring-type debarker that has both a field-replaceable cutting tip with bolts oriented for easy and efficient access, removal and replacement.

It is another object of the invention to provide a debarking tool for a ring-type debarker that can be properly power-torqued while the tool is in operating position on the debarker.

These and other objects and advantages of the invention are achieved in the preferred embodiments disclosed below by providing a tool for a ring-rotor log debarker, comprising an elongate, curved body for being attached by one end to a ring rotor of a log debarker, that includes first and second opposed faces oriented upstream and downstream in general axial alignment with a direction of travel of a log transiting the log debarker from an upstream to a downstream side, and first and second opposed faces oriented radially inwardly and outwardly in a direction generally perpendicular to the direction of travel of the log. At least one attachment hole extends through the curved body of the tool on a free end opposite the one end attached to the ring rotor, and communicates with the first and second upstream and downstream oriented surfaces. A tip is provided for being placed onto the free end of the tool body. The tip has an attachment hole sized and positioned for alignment with at least one attachment hole in the tool body for receiving a bolt through the aligned attachment holes for securing the tip to the tool body with the bolt extending between the first and second upstream and downstream facing surfaces of the tool body.

According to another preferred embodiment of the invention, the free end of the tool body comprises an extension onto which the tip is curved.

According to another preferred embodiment of the invention, the free end of the tool body comprises an extension having a pair of spaced-apart attachment holes therein and the tip includes a pair of spaced-apart attachment holes sized and positioned for alignment with the pair of attachment holes in the tool body for receiving respective bolts through the aligned pairs of attachment holes for securing the tip to the tool body with the bolts extending between the first and second upstream and downstream facing surfaces of the tool body.

According to another preferred embodiment of the invention, the free end of the tool body comprises an extension having a pair of spaced-apart attachment holes therein and the tip includes a pair of spaced-apart attachment holes therethrough sized and positioned for alignment with the pair of attachment holes in the tool body and for receiving respective bolts through the aligned pairs of attachment holes for securing the tip to the tool body with the bolts extending between the first and second upstream and downstream facing surfaces of the tool body.

According to another preferred embodiment of the invention, the extension includes first and second opposed faces oriented upstream and downstream in general axial alignment with a direction of travel of a log transiting the log debarker from an upstream to a downstream side, and first and second opposed faces oriented radially inwardly and outwardly in a direction generally perpendicular to the direction of travel of the log.

According to another preferred embodiment of the invention, the extension includes first and second opposed faces having the same thickness in relation to the thickness of other portions of the tool body. The extension is oriented upstream and downstream in general axial alignment with a direction of travel of a log transiting the log debarker from an upstream to a downstream side, and first and second opposed faces oriented radially inwardly and outwardly in a direction generally perpendicular to the direction of travel of the log.

According to another preferred embodiment of the invention, the tip includes a pair of spaced-apart legs defining a slot sized and shaped to receive the extension of the tool body.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF PREFERRED EMBODIMENT AND BEST MODE

Figure 1:
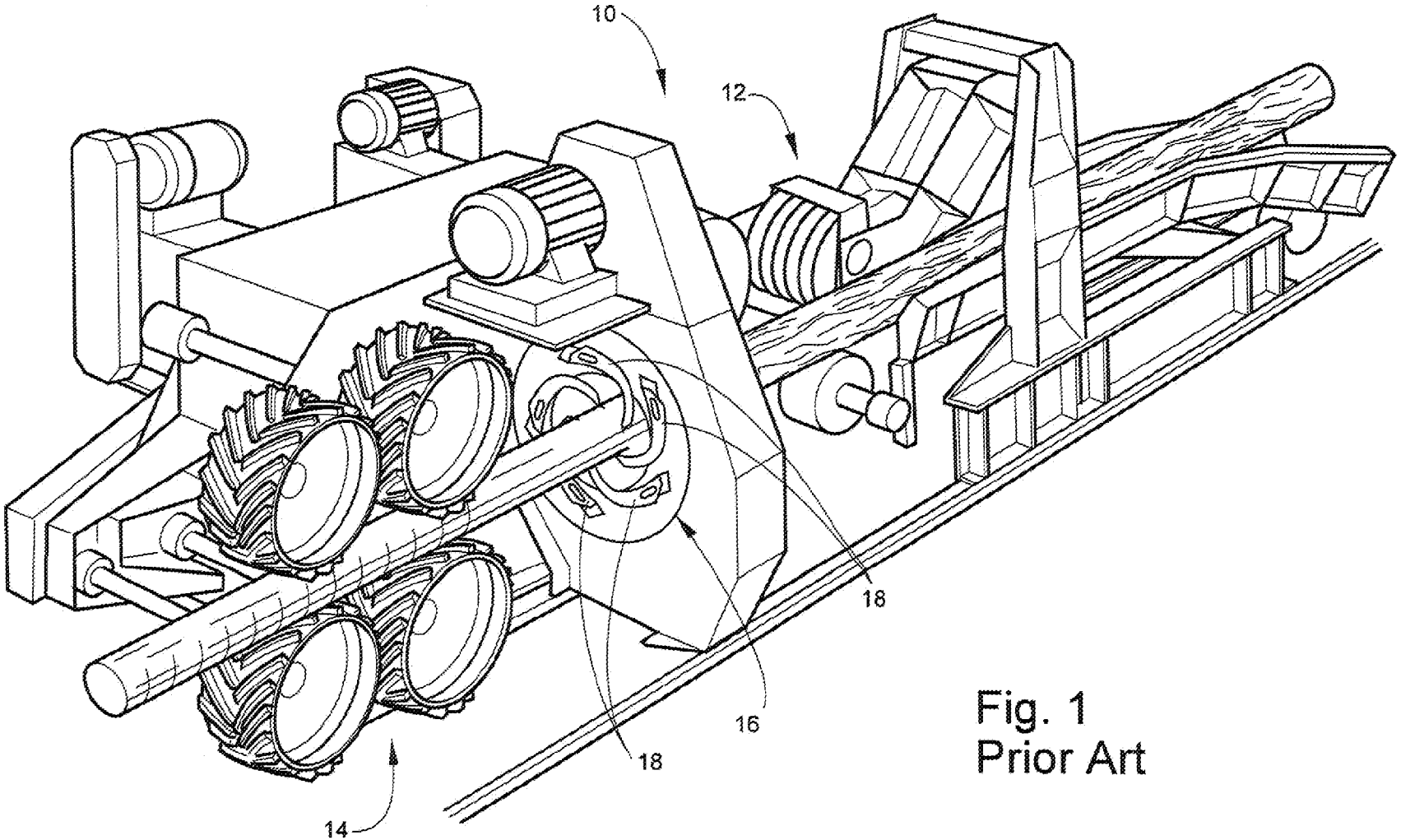
Fig. 1 Prior Art
FIG. 1 is a perspective view of a ring rotor debarker of the general type suited for use with the blade tip according to this application.

Referring now to the drawings, FIG. 1 illustrates a ring-rotor debarker 10 of the general type with which the novel debarking tool and tool tip may be used. The debarker 10 includes an infeed conveyor assembly 12 and feed roll assembly 14, the exact type and design of which are not relevant to the invention. A ring rotor 16 is positioned between the infeed conveyor assembly 12 and the feed roll assembly 14. Prior art ring rotors such as ring rotor 16 include tools 18 that are positioned in a spiral orientation and past which logs move to be debarked, as shown in FIG. 1.

Figure 2:
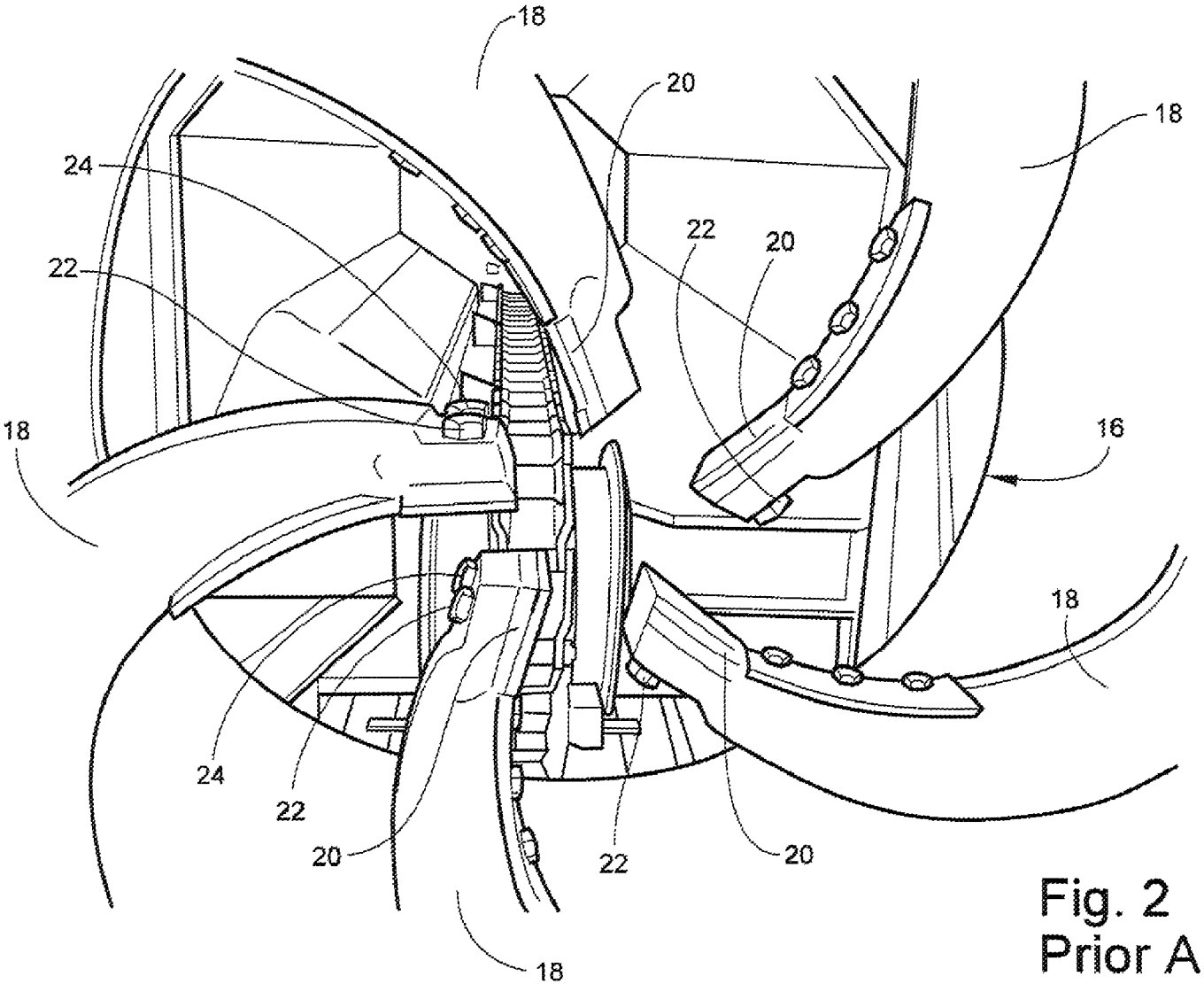
Fig. 2 Prior Art
FIG. 2 is a fragmentary perspective view of a prior art set of ring rotor debarker tools.

As shown more clearly in FIG. 2, the tools 18 include respective tips 20. These tips 20 are removable by means of bolts 22, 24, which extend generally perpendicular to the axis of movement of the log through the debarker 10. This arrangement means that the bolts 22, 24 must be approached from the side, rather than from a more efficient "straight-on" position. As can be seen in FIG. 2, the tool 18 adjacent the bolts 22,24 interfere with such a straight-on approach. The tension on the tools 18 can be released, but the ring rotor 16 must be rotated to position it where the desired tool 18 can be reached. Moreover, applying force to the end of the tool 18 in the orientation shown in FIG. 2 tends to turn the ring rotor 16, moving the tool 18 out of the desired position.

Figure 3:
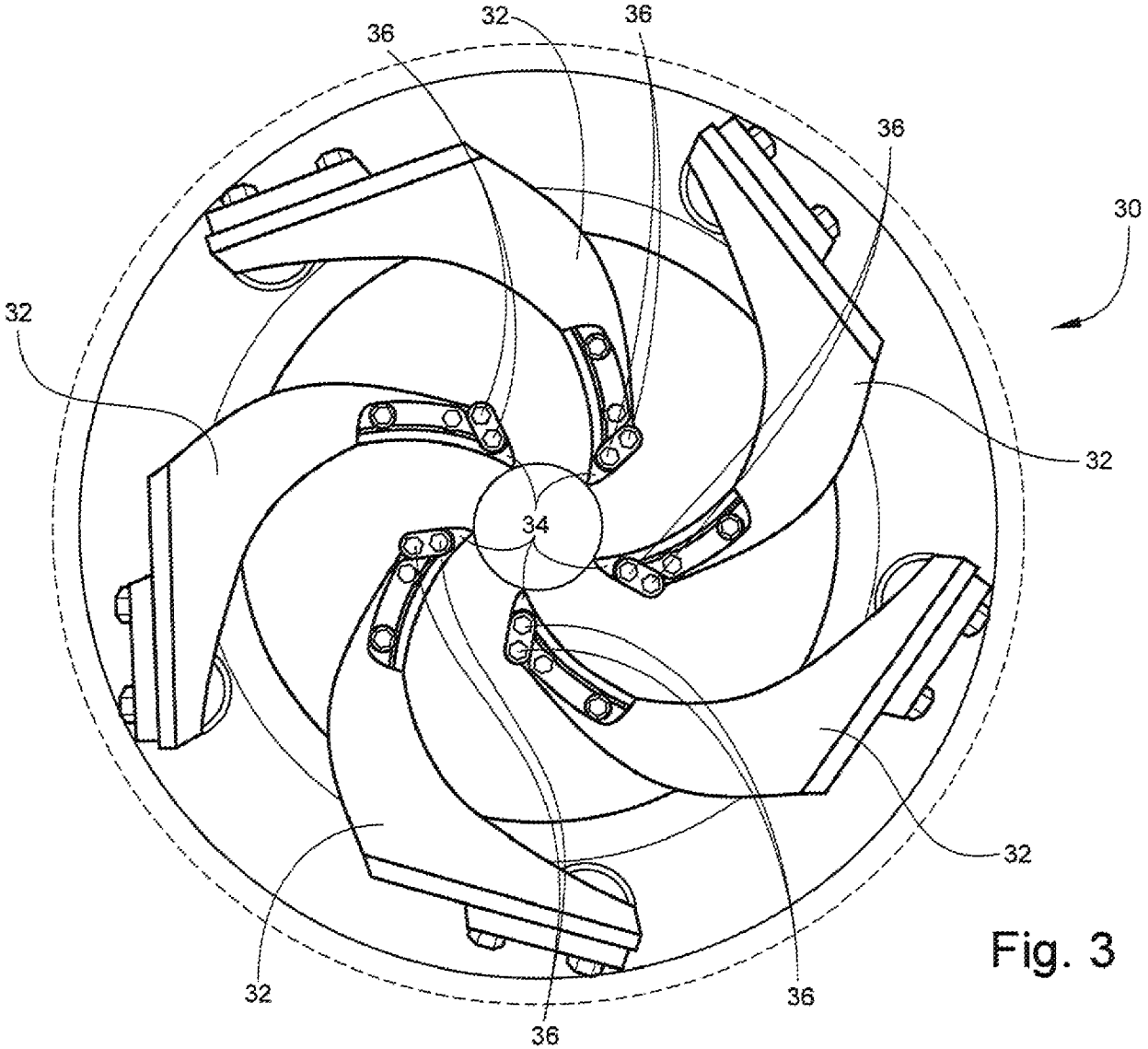
FIG. 3 is a front elevation of a set of ring rotor tools with blade tips according to one embodiment of the invention.

In contrast with the prior art described immediately above, a ring rotor 30 is shown in FIG. 3, and incorporates five tools 32, each of which is provided with a tool tip 34 in accordance with one preferred embodiment of the present invention. Instead of being attached to a side of the tool, the tool tips 34 are slipped onto the end of tool 32 and bolted in place with one or more bolts 36 that extend through the tool 32 and tool tip 34 axially along the direction of travel of the log. This presents the bolts 36 to the head end of the ring rotor 30 where they can be easily reached.

Figure 4:
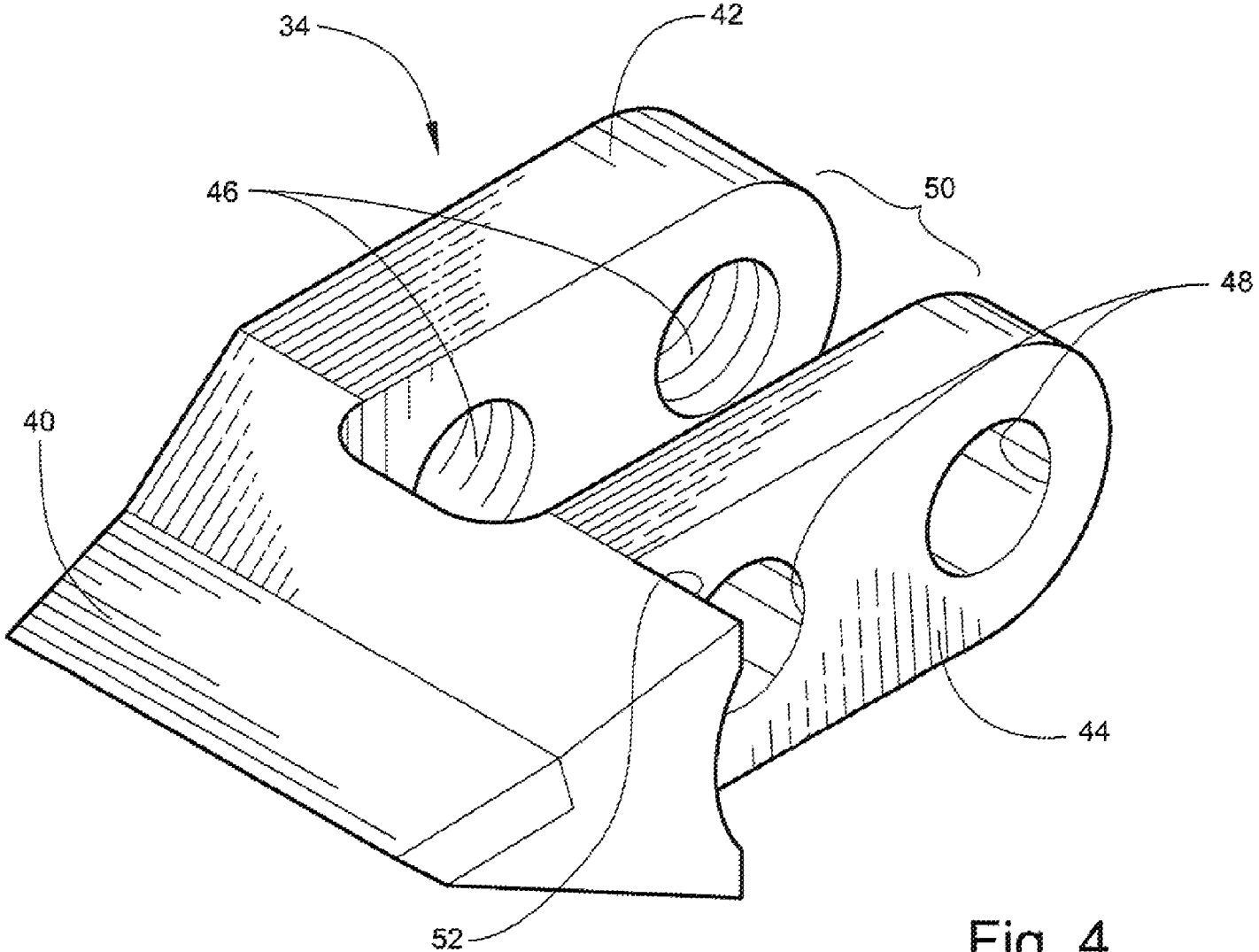
FIG. 4 is an overall perspective view of the tool tip according to the embodiment of the invention disclosed in this application.

The tool tip 34 as shown in FIG. 4 includes a hardened debarking edge 40 and two spaced-apart attachment legs 42, 44 having respective pairs of bolt holes 46, 48. The space between the attachment legs 42, 44 defines a slot 50, and an offset adjacent the attachment leg 44 forms a shoulder 52.

Figure 5:
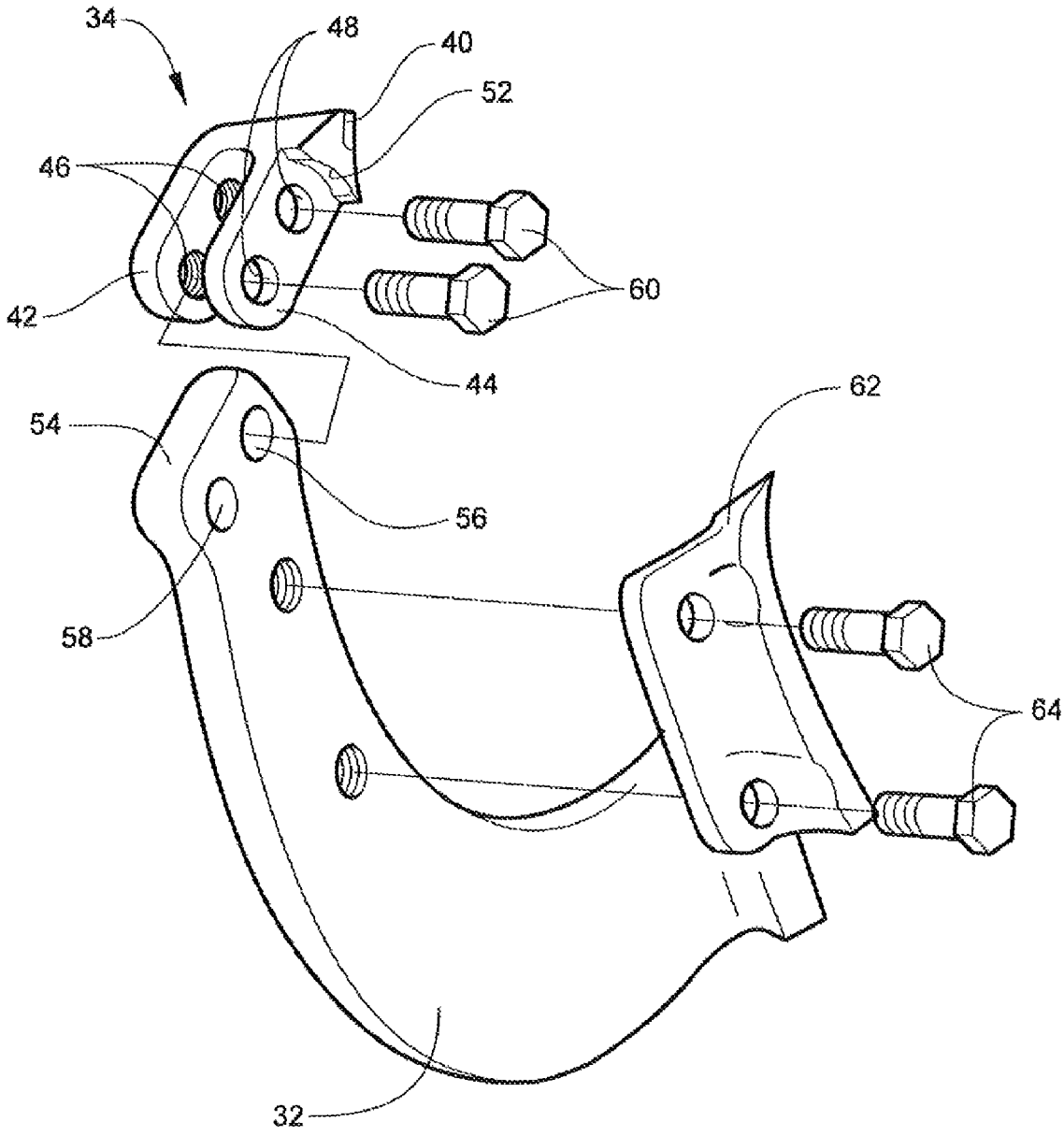
FIG. 5 is an exploded view of the tool and tool tip according to an embodiment of the invention.

As shown in FIG. 5, the tool 32 includes an extension 54 on the free end with two bolt holes 56, 58 that align with the bolt hole 46, as shown, when the tool tip 34 is slipped onto the extension 54. The tool tip 34 is then secured to the tool 32 with bolts 60. The tool 32 shown in FIG. 5 also includes a removable climbing blade 62 that is detachably mounted to the tool 32 by bolts 64.

Figure 6:
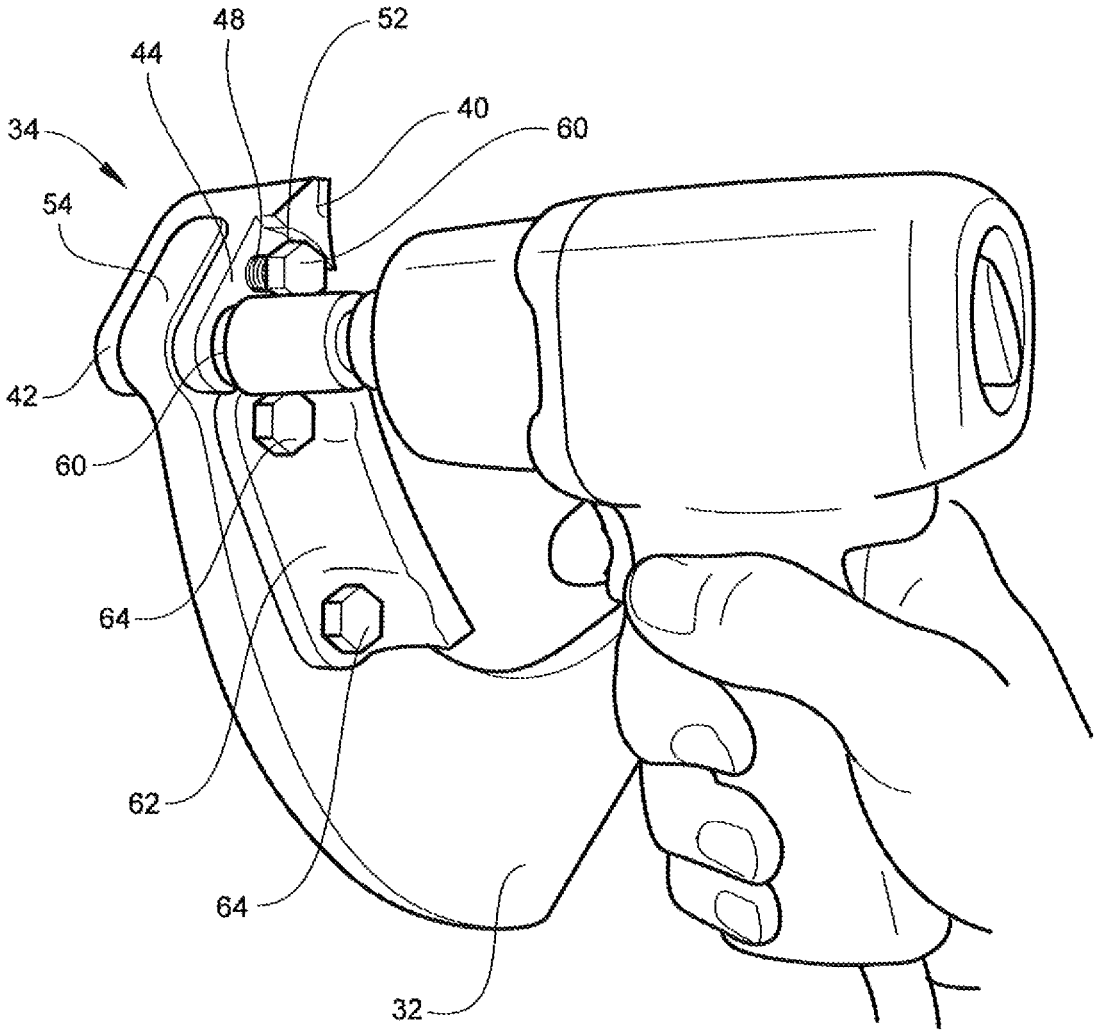
FIG. 6 shows the ability of the blade tip bolts to be easily tightened with a impact wrench due to the orientation of the bolts parallel to the axis on which the logs are fed into the debarker.

Referring to FIG. 6, with the operator facing the ring rotor 30, the bolts 60 are easily removed, the tool tip 34 removed and replaced, and the bolts 60 replaced without any interference from the adjacent tools 32. An impact wrench or similar powered tool can be used to properly torque the bolts without interference from adjacent machine parts.

As shown in FIGS. 4 and 5 the attachment leg 42, 44 is drilled & tapped to form the bolt holes 46, 48. However, the bolt holes 46, 48 can be drilled only and nuts used to attach the bolts 60.

Alternatively, a tool tip in accordance with another embodiment of the invention can be attached to the tool from the front, omitting the rear leg and using only a single front leg for attachment. The debarking edge would otherwise be as shown in the drawings, i.e., perpendicular to the front leg.

Another alternative would be to form the tool tip as a two piece tip with one attachment leg that attaches from the front of the tool and a rear leg with the debarking edge attached and protruding only towards the outfeed of the debarker. This alternative is potentially desirable in applications where the debarking edge must be longer to properly debark logs moving at a relatively high rate through the debarker.

An improved log debarking tool and tool tip is described above. Various details of the invention may be changed without departing from the scope of the invention. Furthermore, the foregoing description of the preferred embodiment of the invention and best mode for practicing the invention are provided for the purpose of illustration only and not for the purpose of limitation, the invention being defined by the claims.

I claim:

1. A tool for a ring-rotor log debarker, comprising:

(a) an elongate, curved tool body having an extension for being attached by one end to a ring rotor of a log debarker, including:

(I) first and second opposed faces oriented upstream and downstream in general axial alignment with a direction of travel of a log transiting the log debarker from an upstream to a downstream side, and first and second opposed faces oriented radially inwardly and outwardly in a direction generally perpendicular to the direction of travel of the log;

(ii) at least one attachment hole extending through the curved body of the tool on a free end opposite the one end attached to the ring rotor, and communicating with the first and second upstream and downstream oriented surfaces; and (b) a tip for being placed onto the free end of the tool body, and having an attachment hole therethrough sized and positioned for alignment with the at least one attachment hole in the tool body and for receiving a bolt through the aligned attachment holes for securing the tip to the tool body with the bolt extending between the first and second upstream and downstream facing surfaces of the tool body, wherein the tip includes a pair of spaced-apart legs defining a slot sized and shaped to receive the extension of the tool body.

2. A tool according to claim 1, wherein the extension has a pair of spaced-apart attachment holes therein and the tip includes a pair of spaced-apart attachment holes therethrough sized and positioned for alignment with the pair of attachment holes in the tool body and for receiving respective bolts through the aligned pairs of attachment holes for securing the tip to the tool body with the bolts extending between the first and second upstream and downstream facing surfaces of the tool body.

3. A tool according to claim 1, wherein the extension includes first and second opposed faces oriented upstream and downstream in general axial alignment with a direction of travel of a log transiting the log debarker from an upstream to a downstream side, and first and second opposed faces oriented radially inwardly and outwardly in a direction generally perpendicular to the direction of travel of the log.

4. A tool according to claim 1, wherein the extension includes first and second opposed faces having the same thickness in relation to the thickness of other portions of the tool body, and further wherein the extension is oriented upstream and downstream in general axial alignment with a direction of travel of a log transiting the log debarker from an upstream to a downstream side, and first and second opposed faces oriented radially inwardly and outwardly in a direction generally perpendicular to the direction of travel of the log.

5. A tool tip adapted for attachment to a tool body of a ring-rotor log debarker, the tool body having an elongate, curved tool body having an extension for being attached by one end to a ring rotor of a log debarker, and including first and second opposed faces oriented upstream and downstream in general axial alignment with a direction of travel of a log transiting the log debarker from an upstream to a downstream side, and first and second opposed faces oriented radially inwardly and outwardly in a direction generally perpendicular to the direction of travel of the log, at least one attachment hole extending through the curved body of the tool on a free end opposite the one end attached to the ring rotor, and communicating with the first and second upstream and downstream oriented surfaces, the tool tip adapted for being placed onto the free end of the tool body, and having an attachment hole therethrough sized and positioned for alignment with the at least one attachment hole in the tool body and for receiving a bolt through the aligned attachment holes for securing the tip to the tool body with the bolt extending between the first and second upstream and downstream facing surfaces of the tool body, wherein the tip includes a pair of spaced-apart legs defining a slot sized and shaped to receive the extension of the tool body.

6. A tool tip according to claim 5, wherein the tip includes a pair of spaced-apart attachment holes therethrough sized and positioned for alignment with a pair of attachment holes in the tool body and for receiving respective bolts through the aligned pairs of attachment holes for securing the tip to the tool body with the bolts extending between the first and second upstream and downstream facing surfaces of the tool body.

7. A tool for a ring-rotor log debarker, comprising:

(a) an elongate, curved tool body having an extension for being attached by one end to a ring rotor of a log debarker, including:

(I) first and second opposed faces oriented upstream and downstream in general axial alignment with a direction of travel of a log transiting the log debarker from an upstream to a downstream side, and first and second opposed faces oriented radially inwardly and outwardly in a direction generally perpendicular to the direction of travel of the log;

(ii) first and second attachments holes extending through the body of the tool on a free end opposite the one end attached to the ring rotor, and communicating with the first and second upstream and downstream oriented surfaces; and (b) a tip for being placed onto the free end of the tool body, and having a pair of attachment holes therethrough sized and positioned for alignment with the pair of attachment holes in the tool body for receiving respective bolts through the aligned attachment holes to secure the tip to the tool body with the bolts extending between the first and second upstream and downstream facing surfaces of the tool body, wherein the tip includes a pair of spaced-apart legs defining a slot sized and shaped to receive the extension of the tool body.

8. A tool according to claim 7, wherein the tip includes a pair of spaced-apart attachment holes therethrough sized and positioned for alignment with the pair of attachment holes in the tool body.

* * * * *